United States Patent [19]

Keitel et al.

[11] 4,328,480

[45] May 4, 1982

[54] SYSTEM FOR MONITORING THE LUBRICATING-OIL PRESSURE OF AN ENGINE

[75] Inventors: Rolf Keitel, Etting; Ernst-Olav Pagel, Böhmfeld; Ludwig Drexler, Wettstetten, all of Fed. Rep. of Germany

[73] Assignee: Audi Nsu Auto Union Aktiengesellschaft, Neckarsulm, Fed. Rep. of Germany

[21] Appl. No.: 184,006

[22] Filed: Sep. 4, 1980

[30] Foreign Application Priority Data

Sep. 6, 1979 [DE] Fed. Rep. of Germany ..... 2935938

[51] Int. Cl.[3] ..... G08B 21/00

[52] U.S. Cl. ..... 340/60; 340/52 F

[58] Field of Search ..... 340/52 F, 52 R, 53, 340/60

[56] References Cited

U.S. PATENT DOCUMENTS 3,723,964 3/1973 Lace ..... 340/52 F 4,021,794 5/1977 Carlson ..... 340/60

*Primary Examiner*—Alvin H. Waring

*Attorney, Agent, or Firm*—Karl F. Ross

[57] ABSTRACT

The pressure of lubricating oil in an internal-combustion engine of an automotive vehicle is monitored with the aid of an oil-pressure sensor and an engine-speed sensor jointly controlling an alarm-signal generator which is activated when the oil pressure falls short of a minimum value assigned to a given engine speed. Also disclosed are test circuits for determining the correct functioning of the two sensors.

10 Claims, 4 Drawing Figures

SYSTEM FOR MONITORING THE LUBRICATING-OIL PRESSURE OF AN ENGINE

FIELD OF THE INVENTION

Our present invention relates to a system for monitoring the pressure of lubricating oil in an engine, especially one of the internal-combustion type such as that of an automotive vehicle.

BACKGROUND OF THE INVENTION

The usual pressure gauges on the dashboards of automotive vehicles emit a visual and somtimes an audible signal when the oil pressure falls below a predetermined threshold. Since, however, this oil pressure tends to increase with engine speed and thus is relatively low under idling conditions, the threshold must be set at a value lower than the minimum idling pressure required in order to avoid the untimely emission of an alarm signal. The rationale for this arrangement is that a sufficient oil pressure at minimum engine speed will insure adequate lubrication also at higher speeds when that pressure is automatically intensified by the acceleration of the engine-driven oil pump.

With a faulty lubricating system, or in the presence of an insufficient amount of oil in the engine, it could still happen under load (e.g. when the vehicle passes through a curve) that the oil pressure drops to a value above the threshold but insufficient for satisfactory lubrication at higher speeds. Thus, the driver may be unaware of a situation which could be damaging to the engine; even if an alarm signal appears at that point, damage may result since the operator may be unable to decelerate the vehicle quickly enough.

To avoid these inconveniences, certain gauges have already been developed which are designed to indicate the amount of oil circulating in the lubricating system. These gauges, however, do not function very accurately when the vehicle is in motion since frequent changes in speed and direction maintain the oil in a state of turbulence.

OBJECTS OF THE INVENTION

The general object of our invention, therefore, is to provide an improved monitoring system for the purpose set forth which minimizes engine damage due to insufficient lubricating oil and operates in a dependable manner at low and high engine speeds.

Another object is to provide means in such a system for alerting the operator to a possible malfunction thereof.

SUMMARY OF THE INVENTION

In accordance with our present invention we provide first and second sensing means for respectively generating a first signal indicative of engine speed and a second signal indicative of oil pressure. An evaluator with input connections to the two sensing means correlates their respective signals with each other and emits a third signal whenever the oil pressure is found to fall short of a predetermined minimum value assigned to a given engine-speed range, this third signal serving to activate alarm means connected to the evaluator.

In a relatively elaborate embodiment of our invention, the evaluator comprises a memory which is addressable by the first sensing means for reading out numerical values assigned to different engine-speed ranges; a comparator receives the numerical value read out in response to the first signal and compares it with the magnitude of the concurrently emitted second signal to determine whether or not the oil pressure lies below the minimum value established for the instant speed range.

A simplified embodiment uses respective threshold circuits as the first and second sensing means, the first signal being emitted in response to engine speeds exceeding a predetermined first limit whereas the second signal is generated in response to oil pressures failing to reach a predetermined second limit. A gate circuit in the evaluator produces the third signal upon concurrent presence of the first and second signals.

Another feature of our invention, usable with either of the two embodiments referred to above, involves the provision of test means connected to an engine-driven generator and to at least one of the aforementioned sensing means for detecting a possible malfunction of the latter, such as an inoperative speed sensor when the engine is in motion or a defective pressure sensor when it is standing still.

BRIEF DESCRIPTION OF THE DRAWING

The above and other features of our invention will now be described in detail with reference to the accompanying drawing in which.

SPECIFIC DESCRIPTION

Figure 1:
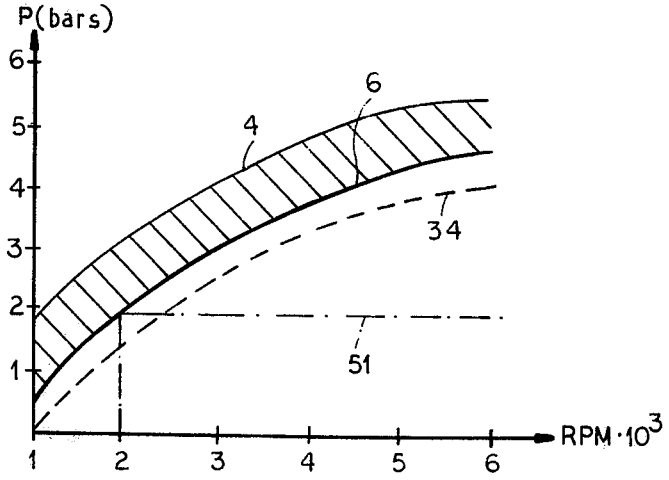
FIG. 1 is a graph showing the relationship between lubricating-oil pressure and speed for a typical vehicular internal-combustion engine.

In FIG. 1 we have plotted lubricating-oil pressure P (in bars) against engine speed (in rpm·$10^3$). Two curves 4 and 6 represent the upper and lower limits of a tolerance range within which the oil pressure may normally vary with changing temperature and viscosity. According to the lower curve 6, the minimum oil pressure P ranges between 0.6 and 4.5 bars for shaft speeds between 1,000 and 6,000 rpm. A further curve 34, generally paralleling curves 4 and 6, represents the minimum level below which the oil pressure should not drop.

Figure 2:
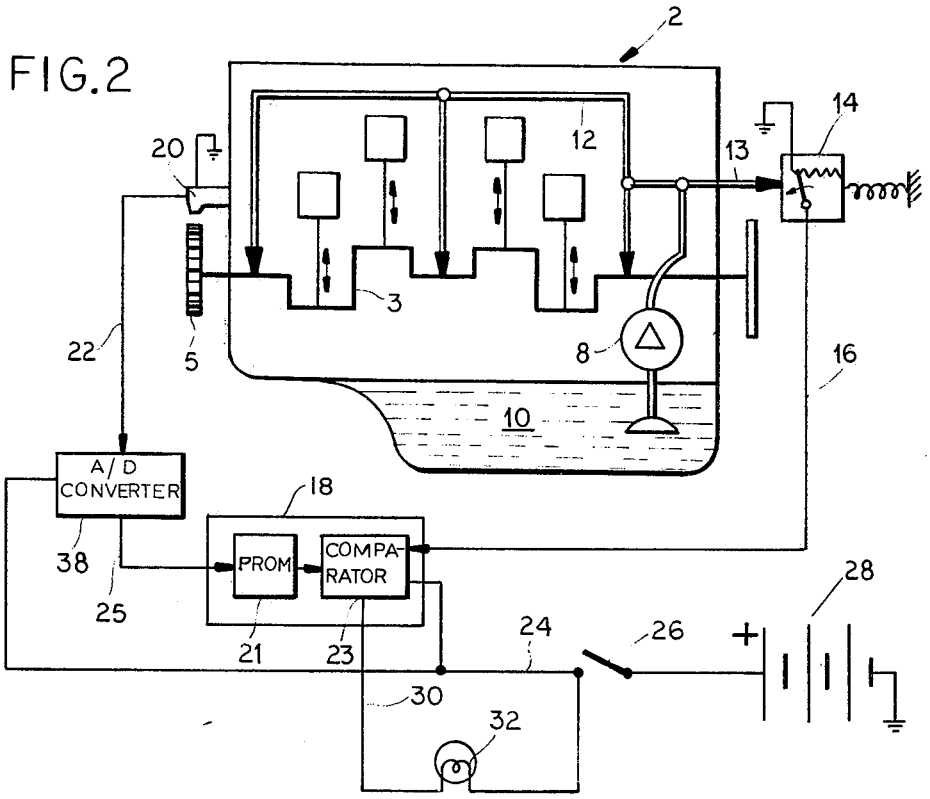
FIG. 2 is a block diagram of the hydraulic and electrical circuits of a pressure-monitoring system embodying our invention.

In FIG. 2 we have schematically indicated a 4-cylinder automotive engine 2 with a crankshaft 3 carrying a toothed wheel 5 which coacts with an electromagnetic or photoelectric speed sensor 20. In the case of an engine equipped with sparkplugs energized by a distributor, the sensor could also be a pick-up coil coupled with that distributor. Lubricating oil is delivered by a pump 8 from a sump 10 via a conduit 12 to the several journal bearings of shaft 3, a spur 13 of this conduit extending to a conventional pressure sensor 14. The two sensors 20 and 14 emit respective signal voltages on output leads 22 and 16 thereof. Lead 22 extends to an analog/digital converter 38 which integrates the voltage pulses of sensor 20 and translates the resulting voltage level into a binary word addressing a programmable read-only memory 21 of an evaluator 18 via a connection 25. Evaluator 18 further includes a comparator 23 with inputs respectively connected to the output of memory 21 and to lead 16. An output lead 30 of this comparator is connected via an alarm lamp 32 to a bus conductor 24 which is connected to a battery 28 upon closure of a switch 26, e.g. the ignition switch of a vehicle equipped with engine 2. Conductor 24 also supplies power to other components of the system, as particularly illustrated for comparator 23 and converter 38.

With switch 26 closed, and with engine 2 operating, comparator 23 determines whether the output signal of pressure sensor 14 has a magnitude at least equal to a numerical value simultaneously read out from a cell of memory 21 addressed by the output multiple 25 of converter 38. If this is not the case, lamp 32 is lit to indicate that the oil pressure lies below the curve 34 of FIG. 1 and that lubrication is insufficient. If the lamp lights only briefly, e.g. during the turning of a curve, the driver may continue to operate the vehicle at moderate speed until the oil supply can be replenished. If the alarm signal persists, the vehicle should be stopped immediately.

Figures 3, 4:
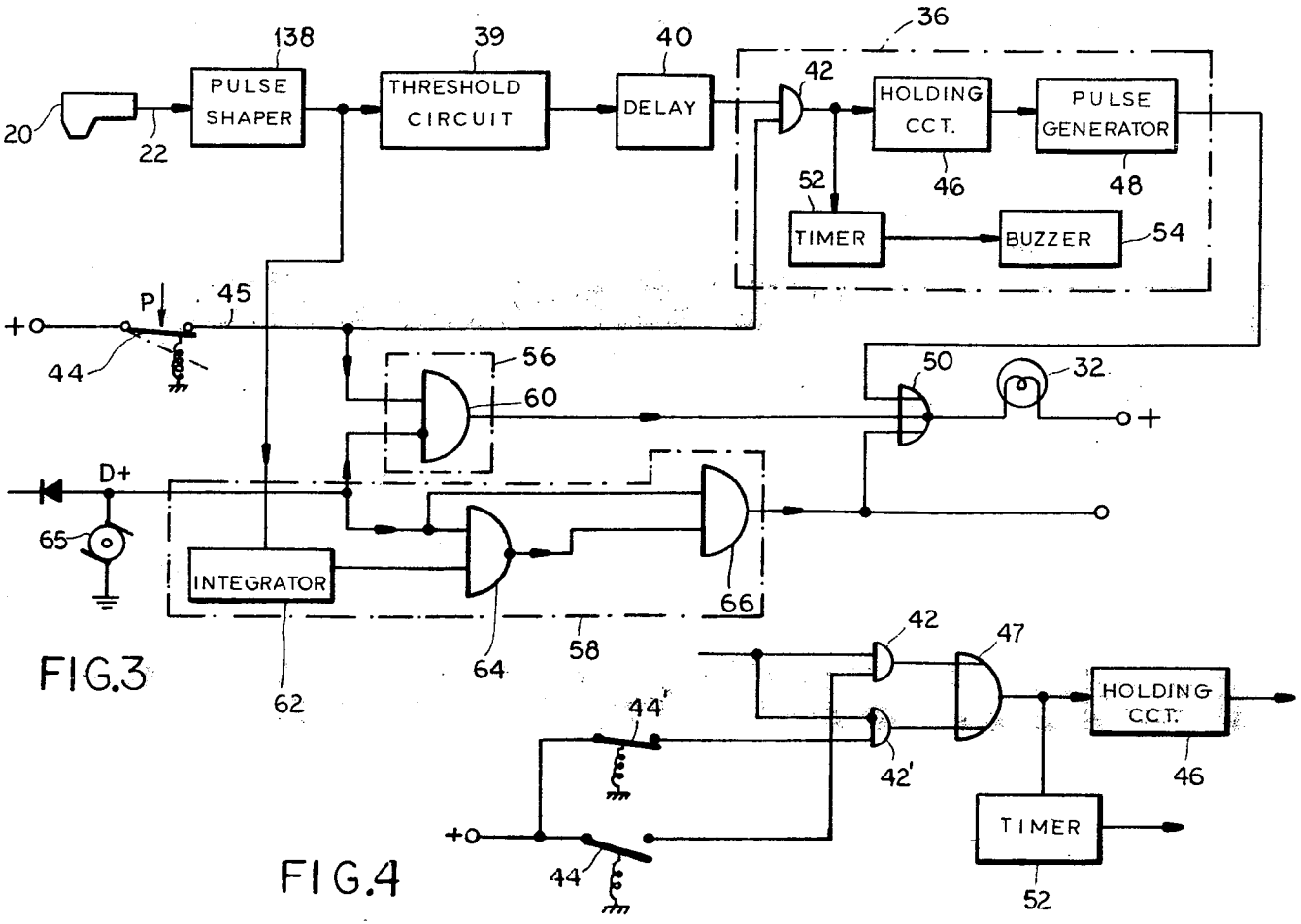
FIG. 3 is a block diagram showing the electrical circuitry of another embodiment.
FIG. 4 illustrates a partial modification of the system of FIG. 3.

In FIG. 3 we have shown a simplified system according to our invention wherein speed sensor 20 feeds a pulse shaper 138 such as a monoflop tripped by the voltage pulses on lead 22. A threshold circuit 39 integrates the rectangular pulses from component 138 and compares the resulting voltage with a predetermined reference potential establishing a certain speed limit such as, for example, 2000 rpm. When the engine operates above that speed limit, a signal emitted by threshold circuit 39 (acting as a binary speed sensor) passes through a delay line 40 to one input of an AND gate 42 forming part of an evaluator 36; another input of this AND gate is connected to an output lead 45 of a binary pressure sensor 44 here shown as a spring-loaded switch which remains closed as long as the oil pressure P in conduit 12 (FIG. 2) lies below a threshold of, say, 2 bars represented in FIG. 1 by a dot-dash line 51. AND gate 42, therefore, conducts whenever an engine speed above 2,000 rpm coincides with an oil pressure below 2 bars to generate an alarm signal which on the one hand actuates a holding circuit 46 and on the other hand trips a timer 52. Circuit 46, upon being thus actuated, continuously drives a pulse generator 48 working into one input of a NOR gate 50 whose output lead includes the alarm lamp 32. Timer 52, when tripped, operates a buzzer 54 for a brief interval of, say, 3 seconds; if desired, however, the buzzer could be connected directly to the output of gate 42.

NOR gate 50 has two further inputs respectively connected to two test circuits 56 and 58. Test circuit 56 comprises an AND gate 60 with a noninverting input tied to lead 45 and with an inverting input connected to the live terminal D+ (here assumed to be positive) of an engine-driven generator 65. If that generator is the one normally provided for recharging the battery 28 of FIG. 2, an isolating diode ought to be inserted between that battery and the inverting input of gate 60. Terminal D+ is also connected to respective inputs of a NAND gate 64 and an AND gate 66 in cascade therewith, these two gates forming part of test circuit 58 which further includes an integrator 62 connected to the output of pulse shaper 138. NAND gate 64 may be replaced by a simple inverter disconnected from generator terminal D+.

With one side of lamp 32 permanently connected to positive battery, the lamp will light only when the output of NOR gate 50 is low, i.e. when at least one of its input leads carries voltage. With pulse generator 48 of evaluator 36 driven by holding circuit 46 as described above, the lamp 32 will flash and alert the operator of the vehicle to an at least temporary deficiency of lubricant. Buzzer 54 will operate only while the deficiency is being detected, e.g. when passing through a curve as discussed above with reference to FIG. 2. Delay line 40 is designed to let the oil pressure reach the higher value associated with engine speeds above 2,000 rpm when the engine is being accelerated above this limit.

Test circuit 56 checks the correct operation of pressure sensor 44. On standstill, generator 65 has zero output so that AND gate 60 conducts (after closure of the ignition switch 26 shown in FIG. 2) if sensing switch 44 is closed, as it should be with pump 8 not driven; such conduction will turn on the lamp 32 as NOR gate 50 is cut off. If, however, switch 44 is defective so that lead 45 is not energized, possibly on account of a line break, gate 60 will be cut off and lamp 32 will remain extinguished as a malfunction signal.

Similarly, test circuit 58 checks the correct operation of speed sensor 20. If the integrated output of pulse shaper 138 is zero or very low when the engine is operating, gates 64 and 66 will both conduct to cut off the NOR gate 50 and energize the lamp 32. The continuous lighting of the lamp under these circumstances (as distinct from its flashing due to insufficient oil pressure at higher speeds) will thus indicate a defect in sensor 20 or a possible break in its circuit.

It will be understood that the single warning lamp 32 could be replaced by several different lamps designed to indicate the various abnormal conditions described above. One such lamp, for example, could be controlled by the test circuits 56 and 58 to indicate a fault in the sensing system. A second lamp may be connected to the output of pulse generator 48 in order to alert the driver to the need for filling in fresh oil at the next opportunity. A third lamp may be connected to the output of AND gate 42 via a further timing circuit (e.g. two lines extending to respective inputs of another coincidence gate with delay means inserted in one of these lines) to give an alarm if insufficient oil pressure persists for an extended interval of, say, 10 seconds.

The system of FIG. 3 is based on the assumption that a sufficient oil pressure at higher speeds (here above 2,000 rpm) will also insure proper lubrication in a lower speed range; it should also be noted that engine speeds of less than 2,000 rpm occur rather infrequently in automotive vehicles. In FIG. 4, however, we have shown a partial modification of the system of FIG. 3 in which a second pressure sensor 44' with a lower biasing force is connected in parallel with sensor 44 and works into a noninverting input of an AND gate 42' having an inverting input connected to the output of delay time 40 (FIG. 3). The two AND gates have outputs connected via an OR gate 47 to holding circuit 46 and timer 52. Sensor 44' may be calibrated, for example, to close at less than 0.4 bar so as to trigger the pulse generator 48 and the buzzer 54 of FIG. 3 when the oil pressure drops below that level at low engine speeds. Lamp 32 would then be normally flashing when the ignition switch is turned on and before the engine is started, provided that test circuit 56 is eliminated or works into a different lamp designed to signal the integrity of circuit 44, 45.

While the system of FIG. 3 or 4 discriminates only between two speed ranges, it will be apparent that several components 39 with different thresholds may be connected in parallel to the output of pulse shaper 138 and, through respective delay lines 40, may work into as many AND gates 42 having second inputs connected to respective sensing switches 44 calibrated for different oil pressures P, similarly to switches 44 and 44' in FIG. 4; the outputs of all these AND gates could be connected through a common OR gate, such as gate 47 of FIG. 4, to the inputs of holding circuit 46 and timer 52 in evaluator 36. The speed ranges established by the several threshold circuits and the minimum pressures measured by the corresponding sensors 44 will then be correlated in conformity with curve 6 or 34 of FIG. 1, substantially as described for the evaluator 18 of FIG. 2.

We claim:

1. A system for monitoring the pressure of lubricating oil in an engine operable at different speeds, comprising:

first sensing means for generating a first signal indicative of engine speed;

second sensing means for generating a second signal indicative of oil pressure;

evaluation means with input connections to said first and second sensing means for correlating said first and second signals with each other and emitting a third signal upon the oil pressure falling short of a predetermined minimum value assigned to a given engine-speed range;

alarm means connected to said evaluation means for activation by said third signal;

an engine-driven generator; and test means connected to said generator and to at least one of said sensing means for detecting a possible malfunction of the latter.

2. A system as defined in claim 1 wherein said evaluation means comprises a memory addressable by said first sensing means for reading out numerical values assigned to different engine-speed ranges, and comparison means connected to said memory and to said second sensing means for comparing the magnitude of said second signal with the numerical value concurrently read out in response to said first signal.

3. A system as defined in claim 1 wherein said first and second sensing means comprise respective threshold circuits emitting said first signal in response to engine speeds exceeding a predetermined limit and emitting said second signal in response to oil pressure failing to reach a predetermined second limit, said evaluation means comprising a gate circuit generating said third signal upon concurrent presence of said first and second signals.

4. A system for monitoring the pressure of lubricating oil in an engine operable at different speeds, comprising:

first threshold-sensing means responsive to engine operation for emitting any of several first signals indicative of different engine-speed ranges;

second threshold-sensing means responsive to oil pressure for emitting any of several second signals indicative of different minimum pressures;

evaluation means including a plurality of coincidence gates with inputs connected to said first and second threshold-sensing means for emitting a third signal upon the oil pressure falling short of a minimum value assigned to a respective engine-speed range correlated therewith; and alarm means connected to said evaluation means for activation by said third signal.

5. A system as defined in claim 4 wherein said second threshold-sensing means comprises a plurality of spring-loaded switches calibrated for said different minimum pressures.

6. A system as defined in claim 1, 2, 3, 4 or 5 wherein said alarm means comprises two distinct indicators, one of said indicators being provided with holding means for maintaining the activation thereof even after disappearance of said third signal.

7. A system as defined in claim 1, 2 or 3, further comprising delay means inserted between said first sensing means and said evaluation means.

8. A system as defined in claim 1, 2 or 3 wherein said generator emits a fourth signal when the engine is in motion, said test means comprising logical circuitry with inputs respectively connected to said first sensing means and to said generator for producing a malfunction indication in the absence of said first signal during presence of said fourth signal.

9. A system as defined in claim 1, 2 or 3 wherein said generator emits a fourth signal when the engine is in motion, said test means comprising logical circuitry with input respectively connected to said second sensing means and to said generator for producing a malfunction indication upon simultaneous absence of said second and fourth signals.

10. A system for monitoring the pressure of lubricating oil in an engine operable at different speeds, comprising:

first binary sensing means for generating a first signal indicative of engine speeds exceeding a predetermined first threshold;

second binary sensing means for generating a second signal indicative of oil pressures falling short of a predetermined second threshold; and evaluation means with input connections to said first and second sensing means for correlating said first and second signals with each other and emitting an alarm signal upon a coincidence of said first and second signals.

* * * * *